United States Patent [19]

Geschwender

[11] Patent Number: 4,786,050

[45] Date of Patent: Nov. 22, 1988

[54] EXERCISE MACHINE

[76] Inventor: Robert C. Geschwender, 3855 Orchard, Lincoln, Nebr. 68503

[21] Appl. No.: 927,396

[22] Filed: Nov. 6, 1986

[51] Int. Cl.[4] ..... A63B 21/00; A63B 67/18

[52] U.S. Cl. ..... 272/73; 272/97; 128/25 B

[58] Field of Search ..... 272/70, 73, 96, 93, 272/97, 69; 128/25 B; 74/47, 48, 66–69; 280/222

[56] References Cited

U.S. PATENT DOCUMENTS

| | | | |
|---|---|---|---|
| 140,878 | 7/1873 | Benson | 74/66 |
| 558,228 | 4/1896 | Stevensson | 74/48 |
| 2,081,365 | 5/1937 | Mueller et al. | 128/25 B |
| 3,566,861 | 3/1971 | Weiss | 272/96 |
| 4,451,033 | 5/1984 | Nestegard | 272/73 |

FOREIGN PATENT DOCUMENTS

| | | | |
|---|---|---|---|
| 876878 | 7/1971 | Canada | 272/73 |
| 2919494 | 11/1980 | Fed. Rep. of Germany | 272/69 |

*Primary Examiner*—Richard J. Apley
*Assistant Examiner*—S. R. Crow
*Attorney, Agent, or Firm*—Senniger, Powers, Leavitt and Roedel

[57] ABSTRACT

An exercise device having a two-sided support, a first double crank journaled in the support, the first double crank having an offset, outwardly extending axle on each side of the support and a second double crank journaled in the support, the second double crank having an offset, outwardly extending axle on each side of the support. A pedal is disposed on each side of the support for the user to stand on, the axle of the first crank supporting the pedal near one end, this axle adapted to move longitudinally relative to its respective pedal, and the axle of the second crank journaled near the opposite end of the pedal, the pedals operable in a cyclic manner to turn the first and second cranks. One of the cranks is rotationally advance relative to the other, and the cranks are connected by a timing belt so that they turn in unison. Handlebars may extend upwardly from each pedal.

18 Claims, 5 Drawing Sheets

EXERCISE MACHINE

BACKGROUND OF THE INVENTION

This invention relates to exercise machines, and in particular to a pedal-type exercise machine for simulating jogging.

Pedal-type exercise machines are popular because they eliminate the jarring and pounding experienced during jogging or running. Furthermore, they allow the user to exercise indoors in safety and comfort. Most pedal-type exercise machines resemble a bicycle, having a seat on which the user sits while operating the pedals. In a seated position, however, only the legs are exercised and furthermore the user's blood flow is restricted. Most of these machines have rigid handlebars, although some machines do have handlebars that move to provide at least some exercise to the upper body.

Pedal-type exercise machines have been made in which the pedal is supported by two double cranks, however in these devices even slight misalignments or variations in size can cause the machine to lock up. These machines have thus been difficult and expensive to manufacture. Even when properly made these double crank machines, as well as the single crank machines, have a "dead center" position in which the pedals are hard to operate and which detracts from the smoothness of the operation.

SUMMARY OF THE INVENTION

Among the objects of the invention is the provision of a pedal-type exercise machine on which the user stands and supports his entire weight during exercise, exercising the entire body and preventing localized restriction of blood flow; the provision of such a machine in which the pedals are supported by and drive two cranks; the provision of such a machine with a smooth and even operation that will not lock up, and which eliminates any dead center position in which it is difficult to operate the pedals; the provision of such a machine which has a simple drive mechanism that can be easily and inexpensively manufactured, and does not require precision made components to prevent lock up; the provision of such a machine that has handlebars that move with a relatively long extension to exercise the user's upper body, and allow the arms to assist with the operation of the machine.

In general, the exercise machine of this invention comprises a two-sided frame and front and back crank mechanisms supported by the frame. Each crank mechanism comprises a crankshaft journaled in the frame for rotation about a generally horizontal axis. A pair of cranks on the crankshaft extend generally radially outwardly from the crankshaft in generally opposite directions on opposite sides of the frame. A crank pin extends laterally outwardly from each crank, generally parallel to but radially offset from the axis of rotation. A pair of elongate pedals is supported on the crank pins of the front and back crank mechanisms, at opposite sides of the frame, the pedals being operable in a cyclic manner to turn the crank mechanisms. The crank pins of one of the crank mechanisms are journaled to the pedals generally adjacent one end of the pedals to permit relative rotation between the pedals and the crank pins as the pedals are operated to turn the crank mechanisms. The crank pins of the other crank mechanism support the pedals generally adjacent the other end of the pedals and are movable in front-to-back direction with respect to the pedals as the pedals are operated to turn the crank mechanisms.

Means, such as a timing belt, preferably connects the cranks so that they turn in unison, with one of the crank mechanisms rotationally advanced relative to the other. The timing belt may also connect the crank mechanisms to a flywheel to stabilize the operation of the mechanism, and provide a load for the pedals. Means can be provided to adjustably brake the flywheel to adjust the load on the pedals. Preferably, a handlebar is attached to each pedal to move therewith and exercise the upper body.

The exercise machine of this invention thus allows the user to stand on the pedals and support his entire weight, exercising the entire body and preventing the localized restriction of blood flow. The two-crank construction with the relative advancement of one of the cranks, and the sliding support of the pedal by one of the cranks achieves a smooth and even operation with no dead center. The requirement of high precision in manufacture and assembly of the components is relaxed, reducing the difficulty and expense of manufacture. The construction also causes the handlebars to have a relatively long extension, exercising the upper body and allowing the arms to assist in the operation of the machine. Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
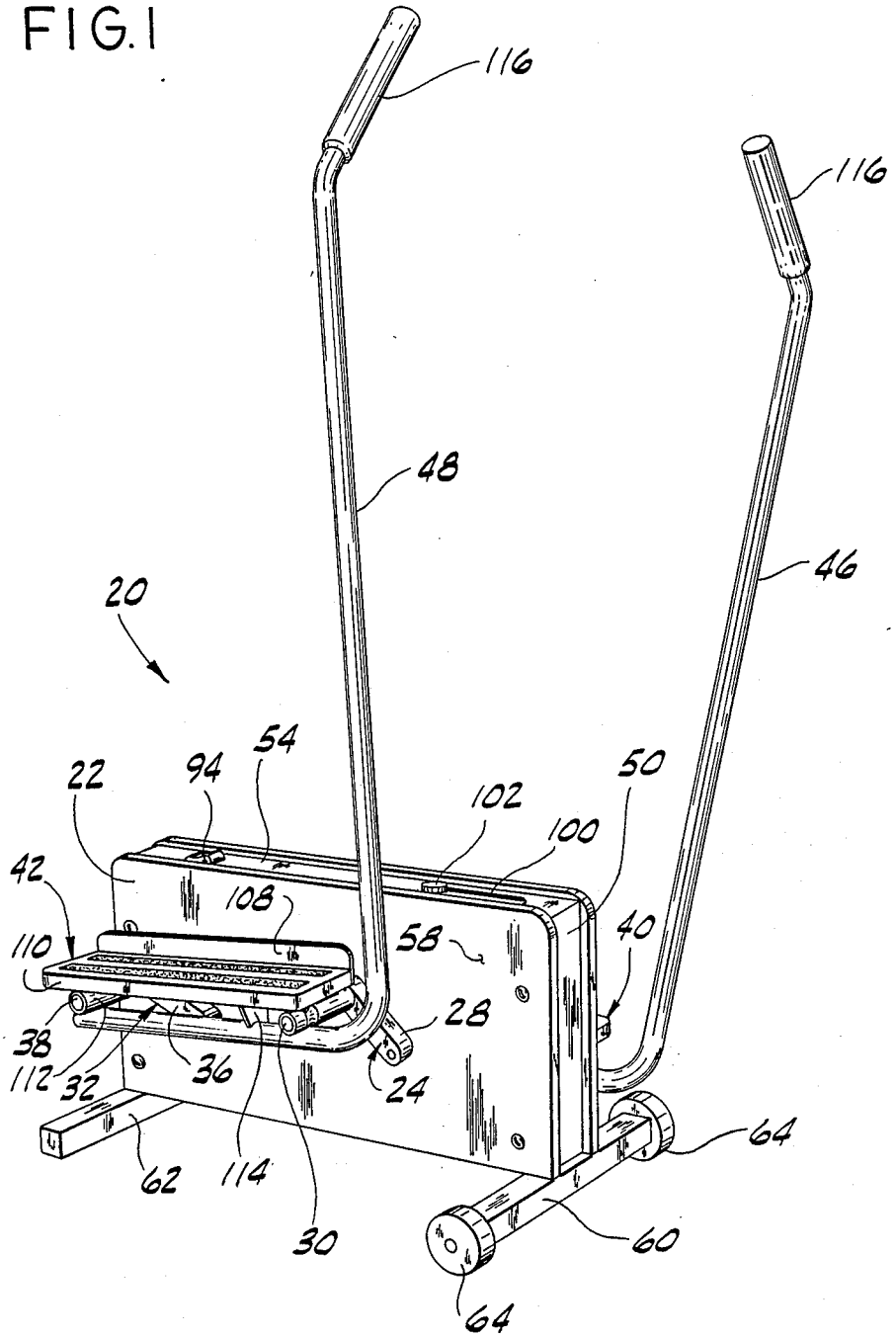
FIG. 1 is a perspective view of an exercise machine embodying the present invention.

An exercise machine constructed according to the principles of this invention is indicated generally as 20 in the Figures. Exercise machine 20 comprises a generally rectangular frame 22 having left and right sides. A front crank mechanism 24, comprising a crankshaft 26, is journaled in frame 22 for rotation about a horizontal axis. A pair of cranks 28 extend generally radially outwardly from the crankshaft 26, in generally opposite directions on opposite sides of the frame. A crank pin 30 extends laterally outwardly from each crank 28, generally parallel to but radially offset from the axis of rotation of the crankshaft. Similarly, a back crank mechanism 32, comprising a crankshaft 34, is journaled in frame 22 for rotation about a horizontal axis. A pair of cranks 36 extend generally radially outwardly from the crankshaft 34, in generally opposite directions on opposite sides of the frame. A crank pin 38 extends laterally outwardly from each crank 36, generally parallel to but radially offset from the axis of rotation of the crankshaft.

Figure 2:
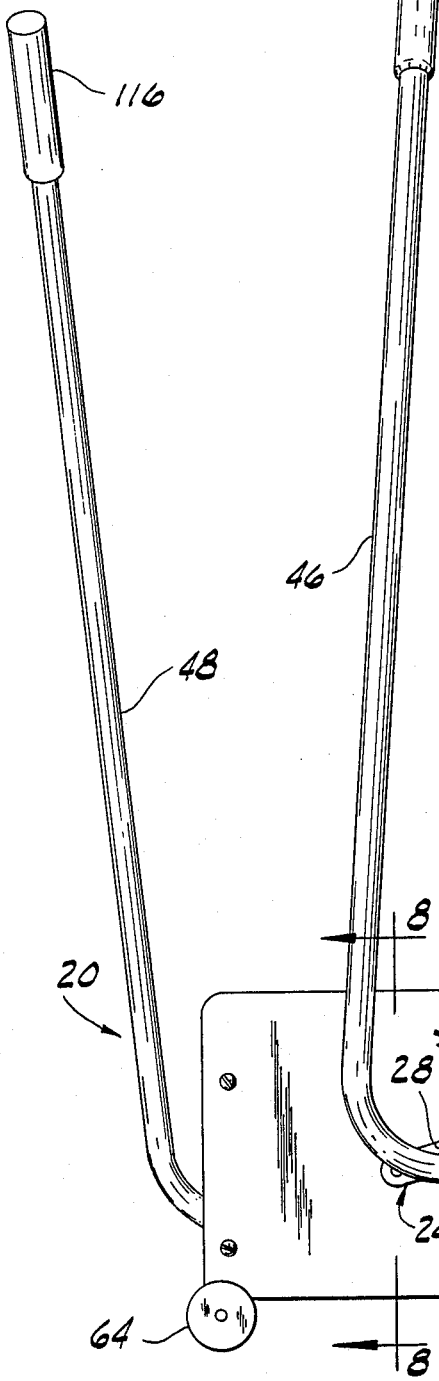
FIG. 2 is a left side elevation view of the machine.
Figure 3:
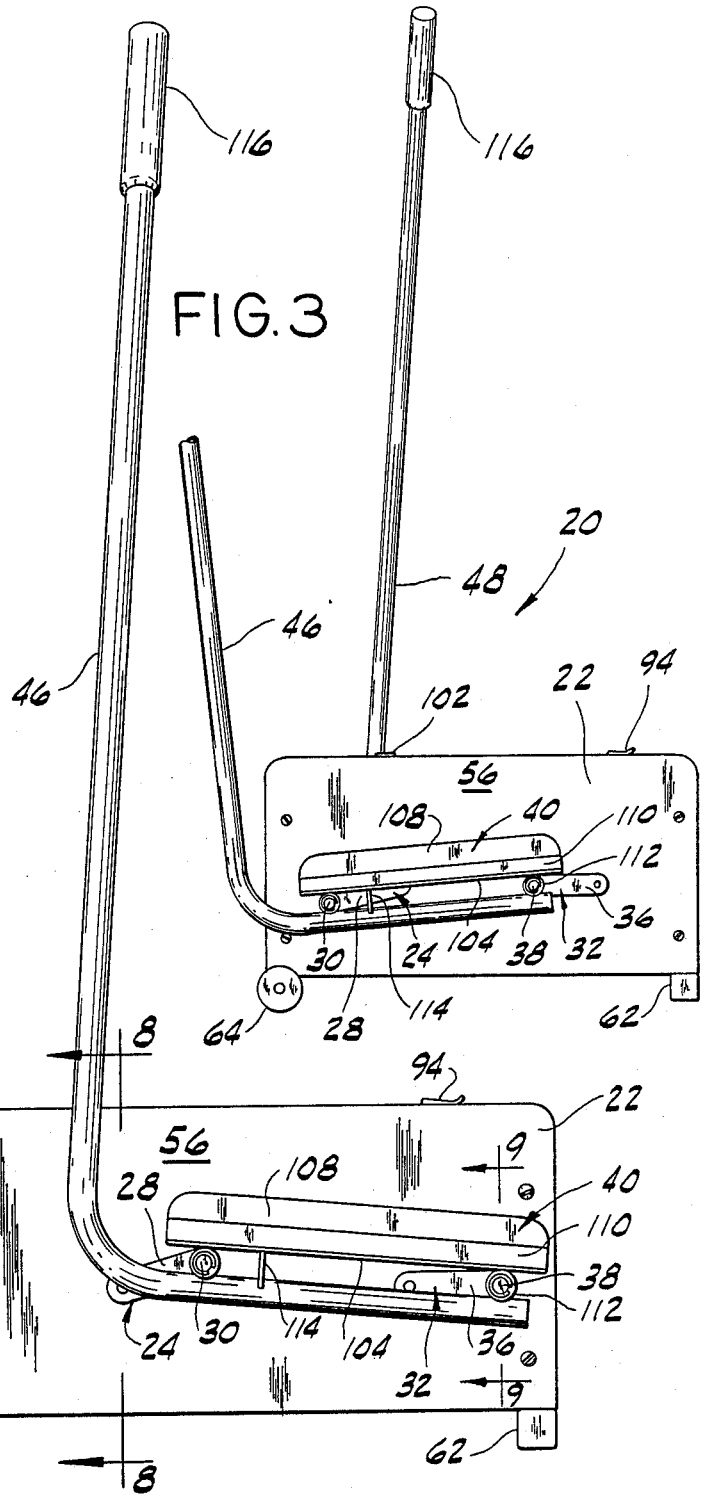
FIG. 3 is a left side elevation view of the machine, with the pedals advanced one half cycle from the view of FIG. 2.
Figure 4:
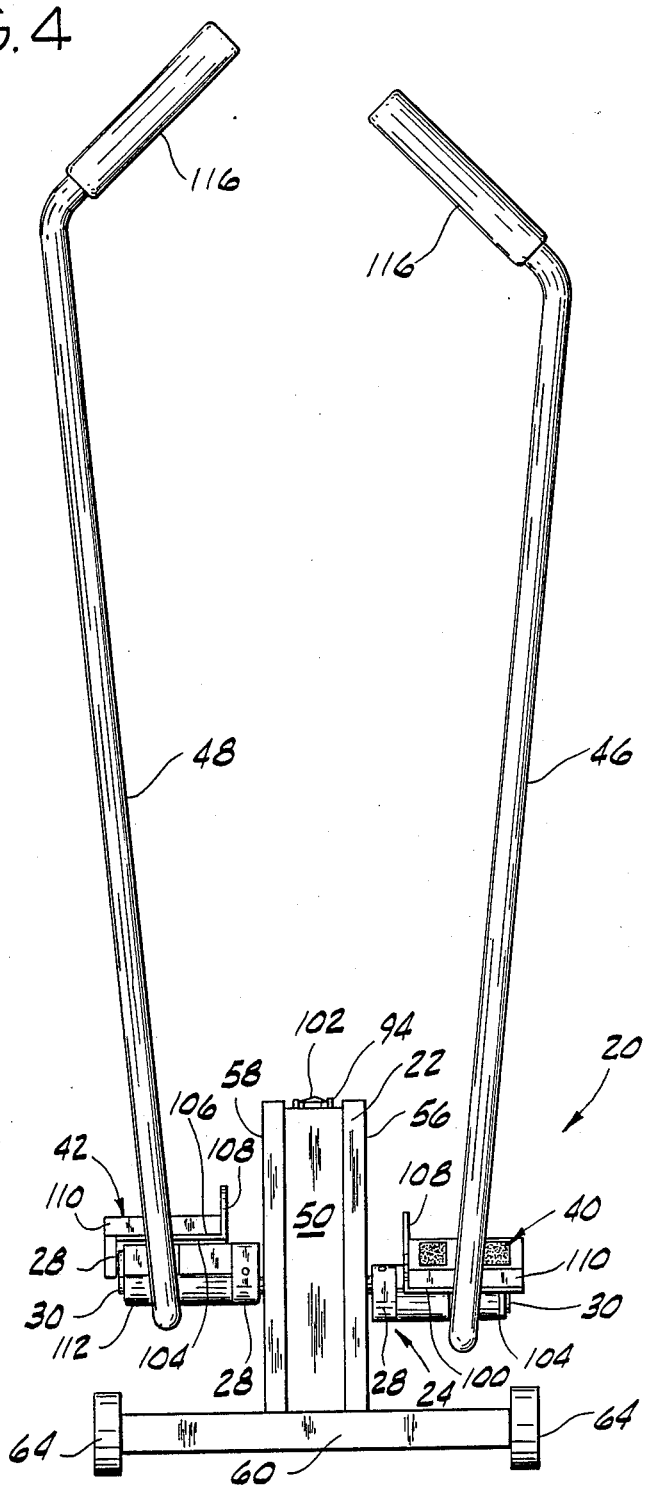
FIG. 4 is a front end elevation view of the machine.

A pair of elongate pedals comprising a left pedal 40 and a right pedal 42 are disposed on the left and right sides of frame 22, respectively. The pedals are supported by the crank pins of the crank mechanisms and are operable in a cyclic manner to turn the crank mechanisms. In the preferred embodiment the crank pins 30 of the front crank mechanism slidingly support the pedals generally adjacent the front end of the pedal, the crank pins being movable in front-to-back direction with respect to the pedals. Crank pins 38 of the back crank mechanism are journaled to the pedals generally adjacent the back end of the pedal. As shown in FIGS. 2 and 3, in the preferred embodiment the cranks 28 of the front crank mechanism are rotationally advanced relative to the cranks 36 of the back crank mechanism.

A timing belt 44 connects the crank mechanisms 24 and 32 and causes them to turn in unison. Left and right handlebars 46 and 48, respectively, extend generally upwardly from their respective pedals.

Figure 5:
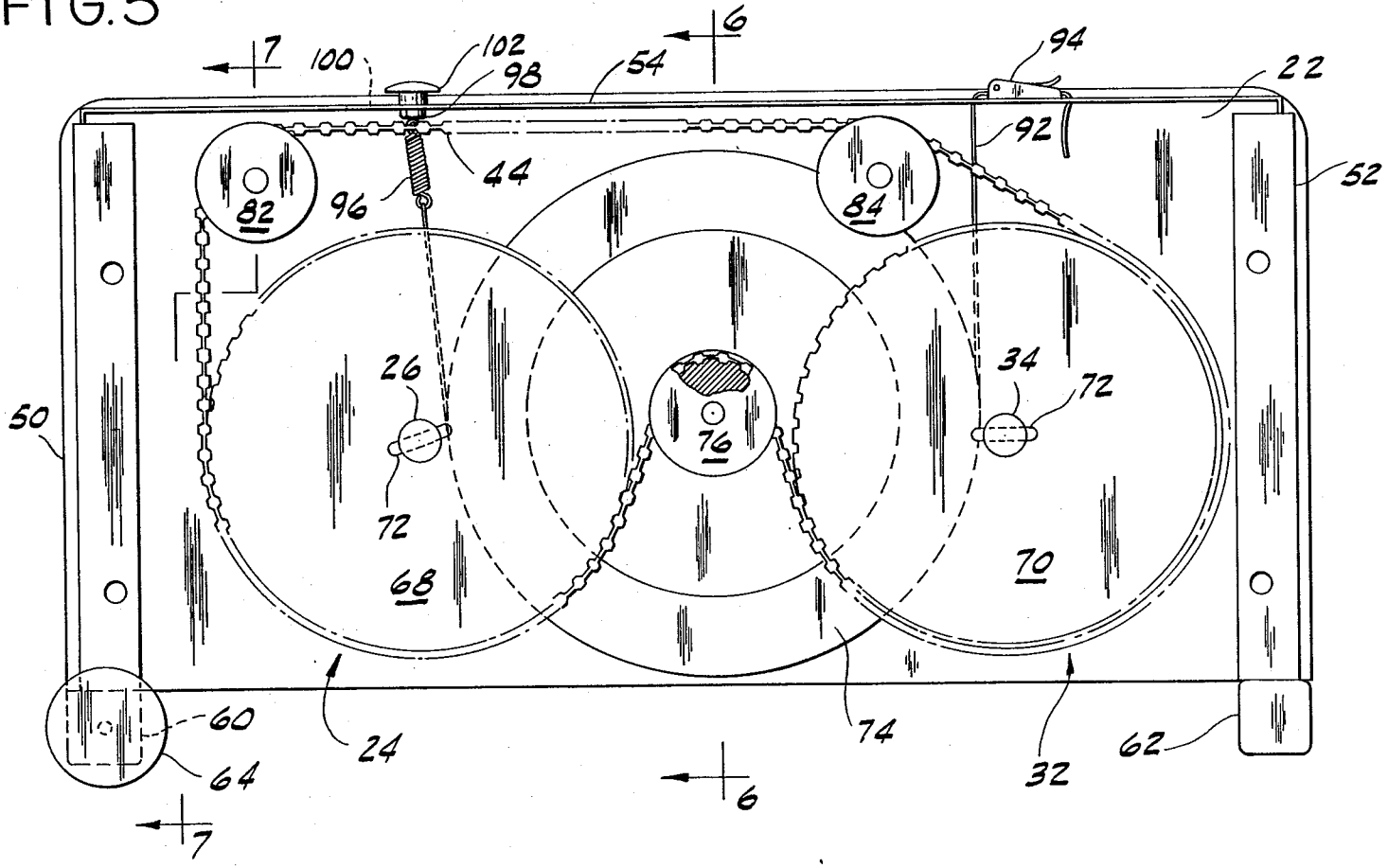
FIG. 5 is a left side elevation view of the machine, with the left pedal and side panel removed, showing the drive mechanism.
Figure 6:
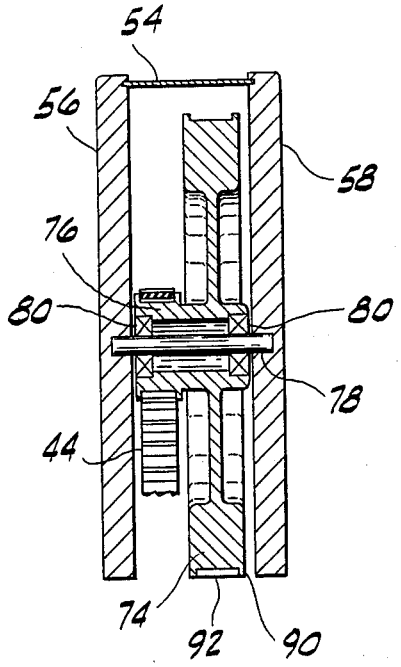
FIG. 6 is a cross-sectional view of the machine taken along the plane of line 6—6 in FIG. 5, showing the flywheel.
Figure 7:
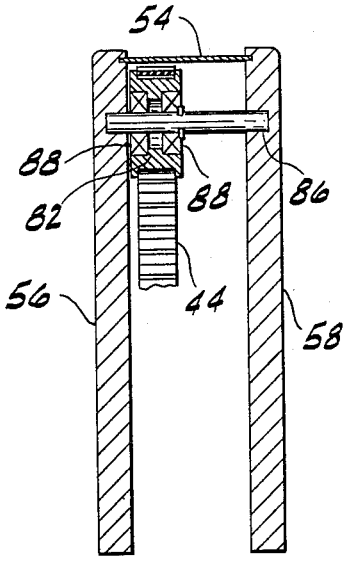
FIG. 7 is a cross-sectional view of the machine taken along the plane of line 7—7 in FIG. 5, showing an idler pulley.

As shown in FIG. 5, frame 22 comprises a vertical front member 50, a vertical back member 52, and a horizontal top member 54 extending between them. Left and right side panels 56 and 58 cover the sides, although the left panel 56 is removed in FIG. 5 to reveal the interior of frame 22. Laterally extending legs 60 and 62 extend from the front and back of frame 22 to stabilize the machine. At least one of the legs can be provided with wheels 64 to facilitate moving the machine. As described above, front crank mechanism 24 and back crank mechanism 32 are journaled in frame 22. See for example FIG. 8, where crankshaft 26 is shown journaled in bearings 66 in side panels 56 and 58. Timing pulleys 68 and 70 are keyed to crankshafts 26 and 34, respectively, with keys 72. A flywheel 74, having a timing pulley 76, is also journaled in frame 22. This is shown in FIG. 6, where the flywheel is mounted on shaft 78, extending between side panels 56 and 58, with bearings 80. Two idler pulleys 82 and 84 are also journaled in frame 22. See for example FIG. 7, where pulley 82 is shown mounted on shaft 86, extending between side panels 56 and 58, with bearings 88. At least one of the idler pulleys can be made movable to allow adjustment of the tension in timing belt 44, which extends around the timing pulley 68 on front crank mechanism 24, over pulley 76 on flywheel 74, around timing pulley 70 on back crank mechanism 32, and over the idler pulleys 84 and 82. As described above, timing belt 44 ensures that crank mechanisms 24 an 32 turn in unison, but the timing belt also provides a driving connection between the cranks and flywheel 74, ensuring an even operation. As is known in the art, timing belt 44 preferably has a plurality of ribs for engaging grooves on the pulleys to prevent slippage.

The circumference of flywheel 74 has a groove 90 for receiving a brake band 92, preferably made from nylon. The back end of brake band 92 is adjustably secured in an over-center type locking buckle 94. The front end of brake band 92 is attached to a spring 96 which is attached to a threaded locking device 98. Locking device 98 slides in a longitudinal slot 100 in the top 54 of the frame, and can be locked in a selected position by turning handle 102 to tighten locking device 98 against the margins of slot 100. The tension of brake band 92, and thus the resistance of the flywheel 74 to rotation, can be adjusted by changing the position of locking device 98 in slot 100. Of course, some other locking means, or some other means of loading flywheel 74, could be used. A scale of relative tensions can be provided on top 54 to help the user select the appropriate tension.

Figure 9:
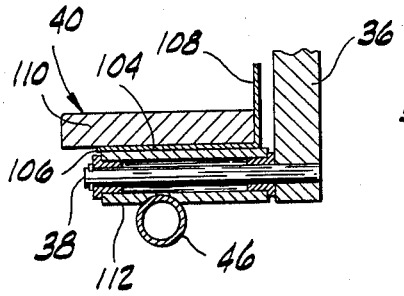
FIG. 9 is a cross-sectional view of a pedal taken along the plane of line 9—9 in FIG. 2, with the rear crank advanced, showing the journaled mounting of the pedals on the rear crank.
Figure 8:
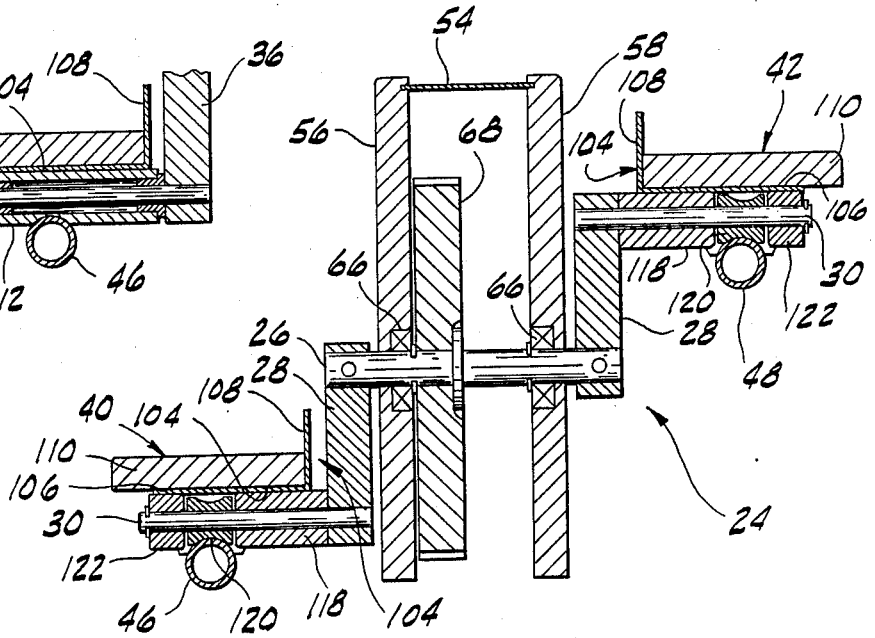
FIG. 8 is a cross-sectional view of the machine taken along the plane of line 8—8 in FIG. 2, with the front crank advanced to show the sliding support of the pedals by the front crank.

As shown in FIGS. 8 and 9, pedals 40 and 42 each comprise an L-shaped metal plate 104 having a horizontal portion 106 and a vertical flange 108 on the inner side to protect the user's ankles. A board 110 is disposed over the horizontal portion 106. A sleeve 112 is attached to the bottom of each plate 104 near the back end. A web 114 depends from each plate 104 intermediate the ends. The handlebars 46 and 48 extend under the plates 104 of their respective pedals, and are attached to the sleeve 112 and web 114, as with welds. Hand grips 116 can be provided on the upper ends of handlebars 46 and 48.

As described above and shown in FIG. 8, the crank pins 30 of front crank mechanism 24 support the front ends of pedals 40 and 42, but can slide relative thereto. An inner roller 118, a grooved middle roller 120, and an outer roller 122, are journaled on each crank pin 30. The inner roller 118 and outer roller 122 support the bottom surfaces of their respective pedals and can roll relative thereto. Middle rollers 120 have a smaller diameter than rollers 118 and 122 so that they do not contact the pedals, but contact the handlebars. The grooves in middle rollers 120 engage the handlebars and prevent the pedals from slipping laterally outwardly. As described above and shown in FIG. 9, the crank pins 38 of back crank mechanism 32 are journaled in the sleeves 112 of their respective pedals.

The front crank mechanism 24 is rotationally advanced relative to the back crank mechanism 32. This is made possible by journaling the crank pins of only one of the crank mechanisms to the pedals; the crank pins of the other crank mechanism support the pedal, but are free to roll in front-to-back direction relative to the pedal during the cycle of the pedal. The advancement of one of the cranks relative to the other provides several advantages: It gives the pedals a slight forward slope on the downward portion of the stroke and a slight rearward slope on the upward portion of the stroke, this slope causes the upper ends of the handlebars move forward and back a much greater distance than the stroke of the cranks, providing increased exercise of the upper body. Furthermore, because the cranks are not parallel, the mechanism cannot lock and there is no dead center position because one of the cranks is always past center.

OPERATION

The user stands on the pedals of the machine supporting his entire weight, and grasps the hand grips of the handlebars. The user then operates the pedals in a cyclic fashion, like a bicycle. On the downward portion of the stroke, the pedal slopes forward, and because of this slope the associated handlebar tilts forwardly more than the forward travel of the pedal. On the upward portion of the stroke, the pedal slopes backward, and because of this slope the associated handlebar tilts backwardly more than the backward travel of the pedal. Thus the user's arms have a long range of motion which stretches and exercises the upper body. The handlebars can be pushed and pulled during the forward and backward portions of the stroke to assist the pedaling. The load on the pedals can be increased by changing the tension of the brake band as described above. The relative advancement of one of the cranks prevents the mechanism from binding, and it eliminates a dead center position where both cranks would be at the bottom of the cycle. This construction, along with the flywheel, provides a smooth, continuous operating cycle.

In view of the above, it will be seen that the several objects of the invention are achieved and other advantageous results are attained.

As various changes could be made in the above construction without departing from the scope of the invention, it is intended that all matter contained in the above description shall be interpreted as illustrative and not in a limiting sense.

What is claimed is:

1. An exercise machine comprising:

a two-sided frame;

front and back crank mechanisms supported by the frame;

each crank mechanism comprising a crankshaft journaled in the frame for rotation about a generally horizontal axis, a pair of cranks on the crankshaft extending generally radially outwardly from the crankshaft in generaly opposite directions on opposite sides of the frame, and a crank pin extending laterally outwardly from each crank, generally parallel to but radially offset from the axis of rotation; and, a pair of elongate pedals supported on the crank pins of the front and back crank mechanisms, at opposite sides of the frame, the pedals being operable in a cyclic manner to turn the crank mechanisms;

the crank pins of one of the crank mechanisms being journaled to the pedals generally adjacent one end of the pedals to permit relative rotation between the pedals and the crank pins as the pedals are operated to turn the crank mechanisms, and the crank pins of the other crank mechanism supporting the pedals generally adjacent the other end of the pedals and being reciprocally movable in front-to-back direction along the pedals as the pedals are operated to turn the crank mechanisms.

2. The exercise machine according to claim 1 further comprising means for causing the front and back crank mechanisms to turn in unison.

3. The exercise machine according to claim 2 wherein the front and back crank mechanisms are rotationally offset so that the cranks of one of the crank mechanisms are in advance of the cranks of the other crank mechanism.

4. The exercise machine according to claim 3 further comprising rollers on those crank pins that move in front-to-back direction with respect to the pedals.

5. The exercise machine according to claim 2 wherein the crank pins of the front crank mechanism support the forward end of the pedals and the crank pins of the back crank mechanism are journaled near the back ends of the pedals.

6. The exercise machine according to claim 5 wherein the cranks of the front crank mechanism are advanced relative to the cranks of the back crank mechanism.

7. The exercise machine according to claim 1 further comprising a flywheel and means for driving the flywheel from at least one of the crank mechanisms.

8. The exercise machine according to claim 7 further comprising means for adjustably increasing the resistance of the flywheel to rotation.

9. The exercise machine according to claim 1 further comprising a handlebar extending upwardly from each pedal to a position where it can be grasped by a user standing on the pedals.

10. An exercise machine comprising:

a two-sided frame;

front and back crank mechanisms supported by the frame;

each crank mechanism comprising a crankshaft journaled in the frame for rotation about a generally horizontal axis, a pair of cranks on the crankshaft extending generally radially outwardly from the crankshaft in generally opposite directions on opposite sides of the frame, and a crank pin extending laterally outwardly from each crank, generally parallel to but radially offset from the axis of rotation; and, means for causing the front and back crank mechanisms to turn in unison, with one of the crank mechanisms rotationally offset from the other so that the cranks of one of the crank mechanisms are in advance of the cranks of the other crank mechanism;

a pair of elongate pedals supported on the crank pins of the front and back crank mechanisms, at opposite sides of the frame, the pedals being operable in a cyclic manner to turn the crank mechanisms; the crank pins of one of the crank mechanisms being journaled to the pedals generally adjacent one end of the pedals to permit relative rotation between the pedals and the crank pin as the pedals are operated to turn the crank mechanisms, and the crank pins of the other crank mechanism supporting the pedals generally adjacent the other end of the pedals and being reciprocally movable in front-to-back direction along the pedals as the pedals are operated to turn the crank mechanisms.

11. The exercise machine according to claim 10 further comprising a flywheel, means for driving the flywheel from at least one of the crank mechanisms, and means for adjusting the resistance of the flywheel to rotation.

12. The exercise machine according to claim 10 wherein the crank pins of the front crank mechanism support and move relative to the pedals and wherein the crank pins of the back crank mechanism are journaled adjacent the back end of the pedals.

13. The exercise machine according to claim 12 further comprising rollers on the crank pins of the first crank mechanism for supporting and rolling on the pedals.

14. The exercise machine according to claim 13 further comprising a handlebar extending upwardly from each pedal to a position where it can be grasped by a user standing on the pedals.

15. An exercise machine comprising:

a two-sided frame;

front and back crank mechanisms supported by the frame;

each crank mechanism comprising a crankshaft journaled in the frame for rotation about a generally horizontal axis, a pair of cranks on the crankshaft extending generally radially outwardly from the crankshaft in generally opposite directions on opposite sides of the frame, and a crank pin extending laterally outwardly from the cranks, generally parallel to but radially offset from the axis of rotation; and, a flywheel;

a continuous, flexible drive element engaging the front and back double crank mechanisms and the flywheel, causing the front and back crank mechanisms and the flywheel to turn in unison, with the front crank mechanism rotationally offset from the back crank mechanism so that the cranks of the front crank mechanism are in advance of the cranks of the rear crank mechanism;

a pair of elongate pedals supported on the crank pins of the front and back crank mechanisms, at opposite sides of the frame, the pedals being operable in a cyclic manner to turn the crank mechanisms;

the crank pins of the back crank mechanism being journaled to the pedals generally adjacent the back end of the pedals to permit relative rotation between the pedals and the crank pins as the pedals are operated to turn the crank mechanisms, and the crank pins of the front crank mechanism supporting the pedals generally adjacent the front end of the pedals and being reciprocally movable in front-to-back direction along the pedals as the pedals are operated to the crank mechanisms;

the pedals being operable in a cyclic manner to turn the crank mechanisms.

16. The exercise machine according to claim 15 further comprising a brake band around the circumference of the flywheel and means for adjusting the tension of the brake band to adjust the resistance of the flywheel to rotation.

17. The exercise machine according to claim 15 further comprising rollers on the crank pins of the front crank mechanism for supporting and rolling on the pedals.

18. The exercise machine according to claim 15 further comprising a handlebar extending upwardly from each pedal to a position where it can be grasped by a user standing on the pedals.

* * * * *

UNITED STATES PATENT AND TRADEMARK OFFICE

CERTIFICATE OF CORRECTION

PATENT NO. : 4,786,050

DATED : November 22, 1988

INVENTOR(S) : Robert C. Geschwender

It is certified that error appears in the above—identified patent and that said Letters Patent is hereby corrected as shown below:

Column 6, claim 10, line 37, "crank pin as the pedals" should read --crank pins as the pedals--.

Signed and Sealed this

Twenty-sixth Day of December, 1989

*Attest:*

JEFFREY M. SAMUELS

*Attesting Officer* *Acting Commissioner of Patents and Trademarks*